US005897428A

United States Patent [19]

Sakcriska

[11] Patent Number: 5,897,428

[45] Date of Patent: Apr. 27, 1999

[54] DEVICE FOR CONTOURING AND SHARPENING ICE SKATE BLADES

[76] Inventor: Glenn Sakcriska, 108 Maple St., Ypsilanti, Mich. 48195

[21] Appl. No.: 08/795,368

[22] Filed: Feb. 4, 1997

[51] Int. Cl.[6] ..... B24B 19/26

[52] U.S. Cl. ..... 451/202; 451/45; 451/205; 451/383; 451/404

[58] Field of Search ..... 451/45, 193, 202, 451/203, 205, 206, 224, 229, 234, 372, 383, 404, 405

[56] References Cited

U.S. PATENT DOCUMENTS

| | | | |
|---|---|---|---|
| 3,797,057 | 3/1974 | Smelden . | |
| 3,988,124 | 10/1976 | Babcock | 451/383 X |
| 4,069,620 | 1/1978 | Sakcriska | 451/383 X |
| 4,078,337 | 3/1978 | Chiasson et al. | 451/383 X |
| 4,392,332 | 7/1983 | Sakcriska | 451/224 |
| 4,685,371 | 8/1987 | Levinson . | |
| 5,009,039 | 4/1991 | Lager et al. | 451/383 X |
| 5,480,345 | 1/1996 | Bethea | 451/234 |
| 5,547,416 | 8/1996 | Timms | 451/234 X |
| 5,645,243 | 7/1997 | Kamagai . | |

*Primary Examiner*—Timothy V. Eley
*Attorney, Agent, or Firm*—Barbara M. Burns

[57] ABSTRACT

A device and method for contouring and sharpening an ice skate blade. The device uses a fixture for holding the ice skate. The fixture employs retractable depending cam rollers to be guided by cam templates recessed into the top surface of the table of the machine. The cam templates are coverable when not in use, thus increasing the usefulness of the top surface of the table. The grinding wheel is movable into and away from the fixture. One of the cam rollers is mounted to an eccentric wheel for pitching the ice skate blade in relation to the grinding wheel. The method comprises the steps of clamping a skate into the fixture, retractably depending or lowering the cam rollers to engage the cam templates in the table of the machine, adjusting the cam roller by operating the eccentric to achieve the desired pitch, moving the grinding wheel to the fixture holding the ice skate and contouring or sharpening the ice skate.

4 Claims, 4 Drawing Sheets

FIG 2
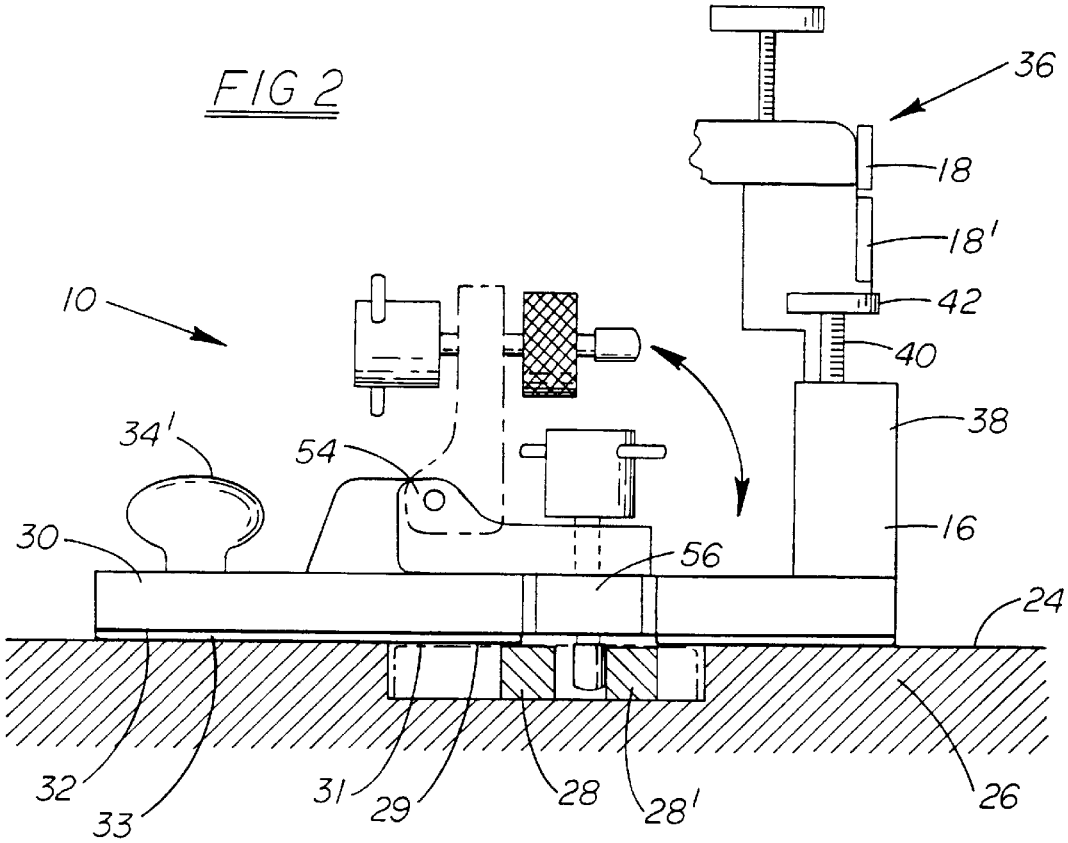
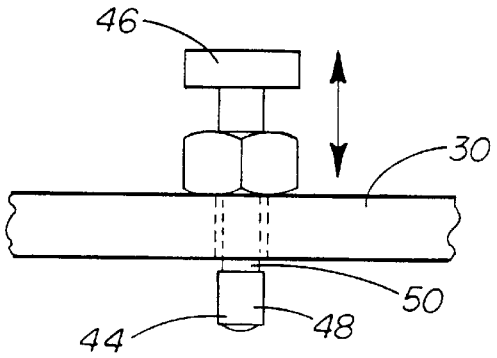
FIG 3

A METHOD FOR SHARPENING
AN ICE SKATE COMPRISING
THE FOLLOWING STEPS

DEVICE FOR CONTOURING AND SHARPENING ICE SKATE BLADES

BACKGROUND OF THE INVENTION

The field of the invention pertains to ice skates. In particular, the invention pertains to a device and method for contouring and sharpening the blade of an ice skate. In the past, the fixture to hold the ice skate had an irregular bottom surface to accommodate cam rollers fixedly mounted thereunder. The cam rollers were engaged with cam templates mounted on the top surface of the table of the grinding machine. A machine of this type is described in my earlier U.S. Pat. No. 4,392,332

The fixture held an ice skate first for contouring the curvature of the ice skate blade and thereafter for grinding the edges of the blade "or sharpening the skates". However, the fixture lacked stability because less than the entirety of the fixture's base plate contacted the top surface of the table. Thus, rocking of the fixture and hence inconsistent grinding or other undesirable results could be observed.

Another disadvantage was that the device for pitching was not a simple device. The device for pitching was employed for changing the curvature of the blade towards the toe of the blade.

Additionally, the fixture was used with cam templates either mounted on the top of the table or were required to be moved into place on the top of the table. Either way, the table was not available or was difficult to use when the device was not being used for the contouring step. Moreover, the cam templates took up usable space wherever they were stored. The permanently positioned top mounted cam templates allowed the build up of grinding dust in between the cam templates, thereby potentially reducing the accuracy of the grind made with the templates and necessitating frequent grinding dust removal.

SUMMARY OF THE INVENTION

It is to an improved device and method for sharpening or contouring an ice skate blade to which the present invention is directed. The fixture holds the ice skate blade for contouring and thereafter for sharpening, or only for sharpening, as needed. Hereafter, it is to be understood that the term sharpening will be used to mean any or all of the following terms, i.e., contouring, grinding and sharpening.

Essentially, the invention comprises a fixture and device that has a planar underside with openings therethrough. The underside is planar across the entire underside and thus facilities the device slidably moving across the flat table of the machine. Cam rollers are retractably disposed on the fixture to engage and remove from cam templates positioned in the machine bed below the flat top of the table. The cam templates are coverable when not in use to extend the usefulness of the top of the table. The cam templates have contours with circular radii of curvature typically between nine to eleven feet. The cam rollers follow the contour of the cam templates and thereby the fixture moves the ice skate blade in a preordained arc against a grinding wheel.

The cam rollers either are mounted on a push pull pin for lowering or raising or on an arm that is swung into a lowered position. One or more of the cam rollers is disposed on an eccentric wheel. By rotating the eccentric wheel, the cam is moved angularly and the ice skate blade held in the fixture is pitched. Pitching of the blade causes the front portion of the blade to be ground more than the rear portion. The pitching of the blade of the skate moves the skate wearer's knees into a bended position thus creating a kinetic spring to be powerfully uncoiled when the skater moves.

Therefore, the pitching of the blade by the fixture allows different desirable contours to be imparted to the blade. A hockey defenseman requires a different skate blade contour from a hockey forward. The eccentrically mounted cam roller allows different radiuses and hence different depth of grinds to be made to the forward portion of the blade. Thus, the blade is pitched independently of any requirement to pitch the fixture.

The purpose for which the skate is to be used also impacts the contouring of the skate. For instance, a hockey defenseman's skate is desired to have a rounder radius than a goalie's skate, which should have a flatter or larger radius.

Immediately following the contouring step using the roller cams and the cam templates, the fixture is easily slid to a sharpening position without detaching the fixture from the templates. However, when detachment of the fixture from the templates is desired, the fixture is released from the templates merely by operating the push pull pin thereby raising the cam roller from the templates and/or operating the swing arm thereby also raising the cam roller from the templates.

Consideration of the wearer's physique and skill level factor into the contouring and pitching of the skate blade. A lesser contour radius should be imparted to the skate of a knock kneed skater, while a greater contour radius should be imparted to the skate of a novice skater. A greater contour radius should be imparted to the skate of a skate wearer having inner thighs that are close together.

It is envisioned that the device and method can be advantageously employed with a variety of skate sharpening devices. An advantage of this new method is that when using the fixtures, the skate blade remains clamped and the sharpening of the skate blade can be accomplished readily and easily after the contouring step.

For a more complete understanding of the present invention, reference is made to the following detailed description when read with in conjunction with the accompanying drawings wherein like reference characters refer to like elements throughout the several views, in which:

BRIEF DESCRIPTION OF THE DRAWINGS

FIG. 2 illustrates a right side view of the device showing a partial view of the fixture with the pitchable cam roller deployed in the non-retracted position engaging the cam templates within the table;

FIG. 3 illustrates a side view of the fixture showing the retractable cam roller;

DESCRIPTION OF THE PREFERRED EMBODIMENTS

Figure 1:
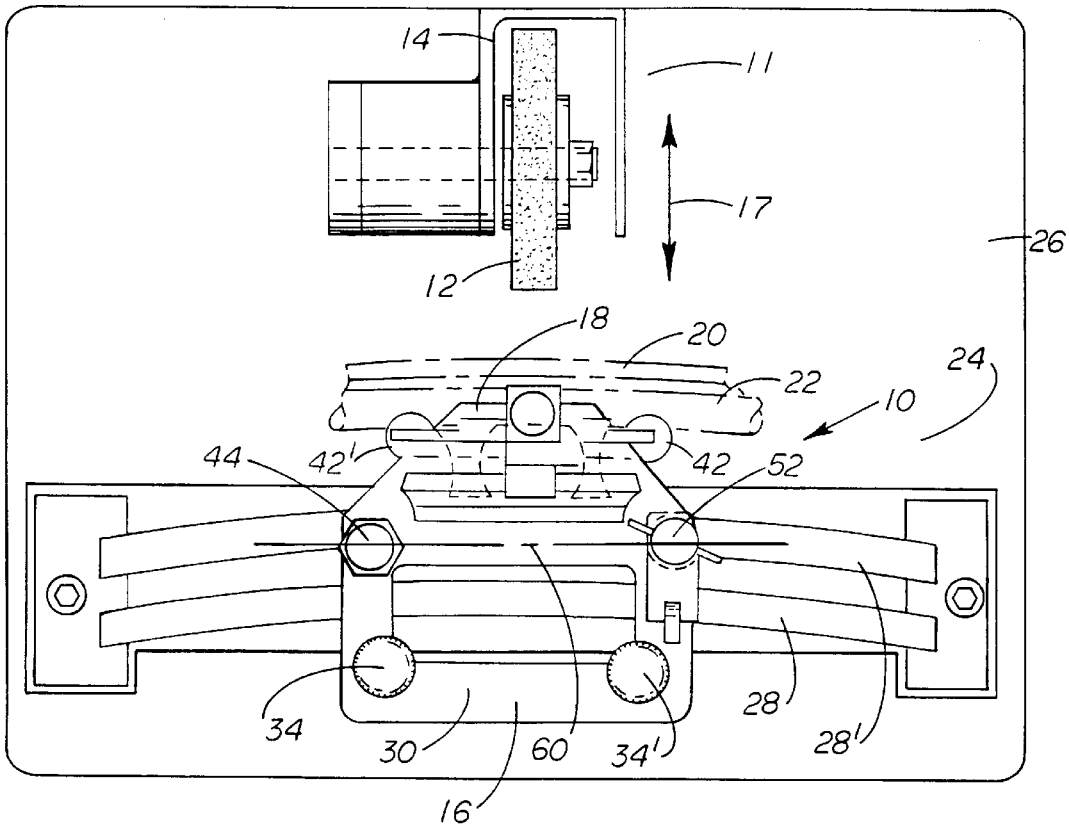
FIG. 1 illustrates a plan view of the skate sharpening device according to the invention.

In FIGS. 1 and 2, an ice skate sharpening device generally denoted as 10 is thereshown. The ice skate sharpening device 10 comprises means for sharpening 11 such as a rotatable grinding wheel 12 housed in a housing 14 and movable into and away from a fixture 16. Other means for sharpening such as water jets or lasers could also be employed advantageously herein. The fixture 16 has clamping plates 18, 18' for clamping the blade 20 of an ice skate 22. The fixture 16 slides along the top surface 24 of a table 26 with the fixture 16 being moveable into and away from the grinding wheel 12 as shown by the arrow 17. Beneath the top surface 24 of the table 26 are emplaced contour or cam templates 28, 28', etc. Means for covering 29 the cam templates 28, 28' when not in use comprise a plate 31 (shown in phantom in FIG. 2) or slat, etc. fittable into the table 26 and level with the top surface 24 of the table 26.

In FIG. 2, the fixture 16 is thereshown in a side view. The fixture 16 has a base plate 30 having a planar underside 32. Felt 33 is affixed to the planar underside 32 to facilitate the movement of the fixture 16. The base plate 30 can have openings therethrough for weight reduction of the base plate 30 and hence also of the fixture 16. Operating knobs 34, 34' at the back of the fixture 16 help the machine operator to move the fixture 16 as will be described more fully hereinbelow.

The front of the fixture 16 contains a skate holding assembly 36. The skate holding assembly 36 comprises the clamping plates 18, 18' which are raised above the base plate by ariser 38.

Means for adjusting the height 40 of the clamping plates 18, 18' comprise adjustment screws 42, 42' disposed on opposite ends of the riser 38. Other means for adjustment could be wedges, spacers, etc. The adjustment screws 42, 42' are threaded into the riser 38 and are adjusted by threading more deeply into the riser 38 to reduce the height of the heads of the screws and thereby the height of the clamping plates 18, 18'. Alternately, the adjustment screws 42, 42' are partially threaded less deeply into the riser 38 to raise the heads of the screws 42, 42' and thereby raise the clamping plates 18, 18'. The means for adjusting the height 40 allows for the fixture 16 to present the blade 20 to the grinding wheel 12 at the appropriate height for the grinding wheel 12.

The grinding wheel 12 in FIG. 1 is shown with the diameter of the grinding wheel 12 as being perpendicular with the top surface 24 of the table 26 of the machine, or in a normal position. For the contouring of ice skates this is a common orientation of the grinding wheel. However, for the sharpening of ice skates, it is to be understood that the grinding wheel may be orientated with the diameter of the grinding wheel 12 as being disposed parallel with the top surface 24 of the table 26, or in a horizontal position.

FIG. 3 depicts a side view of the retractable roller cam 44. The retractable roller cam 44 is emplaced on the left side of the fixture 16 (FIG. 1) but could be emplaced to the right side if so desired. The retractable roller cam 44 is essentially a push pull pin 46 having a rotatable roller 48 mounted thereon on the lower side 50. The roller 48 engages with a cam template 28 in the table when the fixture 16 is positioned over the cam templates 28, 28' and the push pull pin 46 is extended downwardly lowering the cam roller 48.

Figure 4:
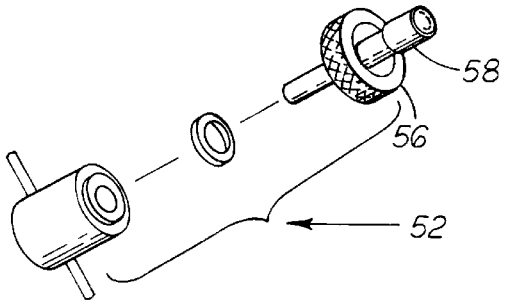
FIG. 4 illustrates a partial exploded view of the adjustable retractable cam roller.
Figure 5:
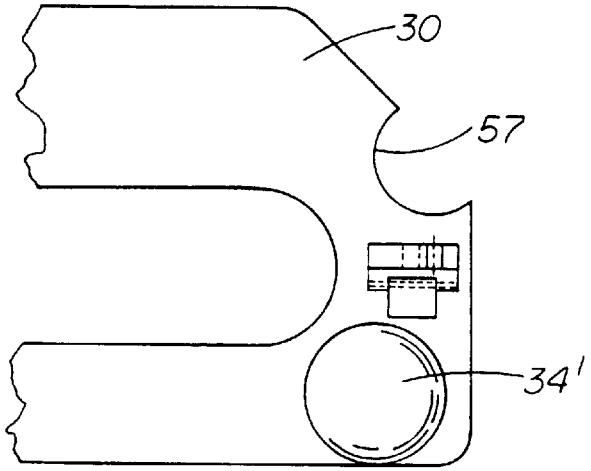
FIG. 5 illustrates the adjustable retractable cam roller arm in the up position showing the receiving aperture in the fixture base.

FIG. 4 depicts an exploded view of the adjustable retractable roller cam 52. The adjustable retractable roller cam 52 is emplaced on the right side of the fixture 16 (FIG. 1). Emplacement of the adjustable retractable roller cam 52 on the right side of the fixture 16 facilitates the using of the fixture 16 by a right handed operator. However, the adjustable retractable roller cam 52 can be emplaced on the left side of the fixture 16 with the retractable roller cam 44 described above emplaced to the right side of the fixture 16.

The adjustable retractable roller cam 52 comprises an offset swing arm 54 (FIG. 2) pivotally attached to the fixture 16, an eccentric device such as an eccentric wheel 56 and a roller cam 58 attached to the eccentric wheel 56. The adjustable retractable roller cam 52 is mounted through the offset swing arm 54. The offset swing arm 54 is lowered thus lowering the eccentric wheel 56 into a receiving aperture 57 in the base plate 30 and moving roller cam 58 into position to be directed along the desired cam template 28.

As described hereinabove, the roller cam 58 is attached to an eccentric wheel 56. Turning the eccentric wheel 56 moves the roller cam 58 angularly in relation to a center line 60 between the centers of the retractable roller cam 44 and the adjustable retractable roller cam 52. The angular movement of the adjustable retractable roller cam 52 moves the entire fixture 16 to create the pitching angle and to impart the pitching angle to the blade as the blade is sharpened.

Figure 6:
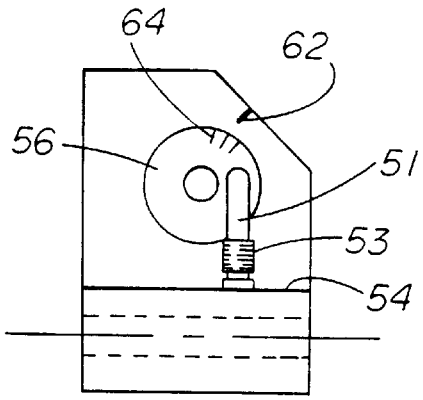
FIG. 6 illustrates a top view of a fine adjustment for the eccentric wheel.
Figure 7:
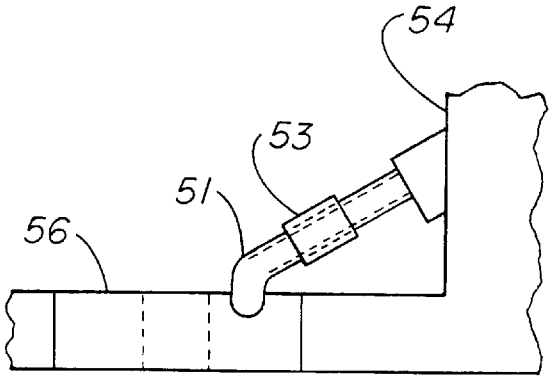
FIG. 7 illustrates a side view of the fine adjustment for the eccentric wheel.

FIGS. 6 and 7 depict an alternate embodiment for adjusting pitch. A fine adjustment assembly 51 acts upon the eccentric wheel 56 to adjust the pitch factor in fine increments. The fine adjustment assembly 51 comprises a worm screw 53 that operates against the offset swing arm 54.

The offset swing arm 54 has indicator marks 62 inscribed thereon the top surface of the offset swing arm 54 and down the angled surface perpendicular to the indicator mark on the top surface to correlate with indicator marks 64 inscribed on the eccentric wheel 56. The indicator marks 62, 64 allow the pitching angle to be duplicated and repeatably ground on different blades.

Figure 8:
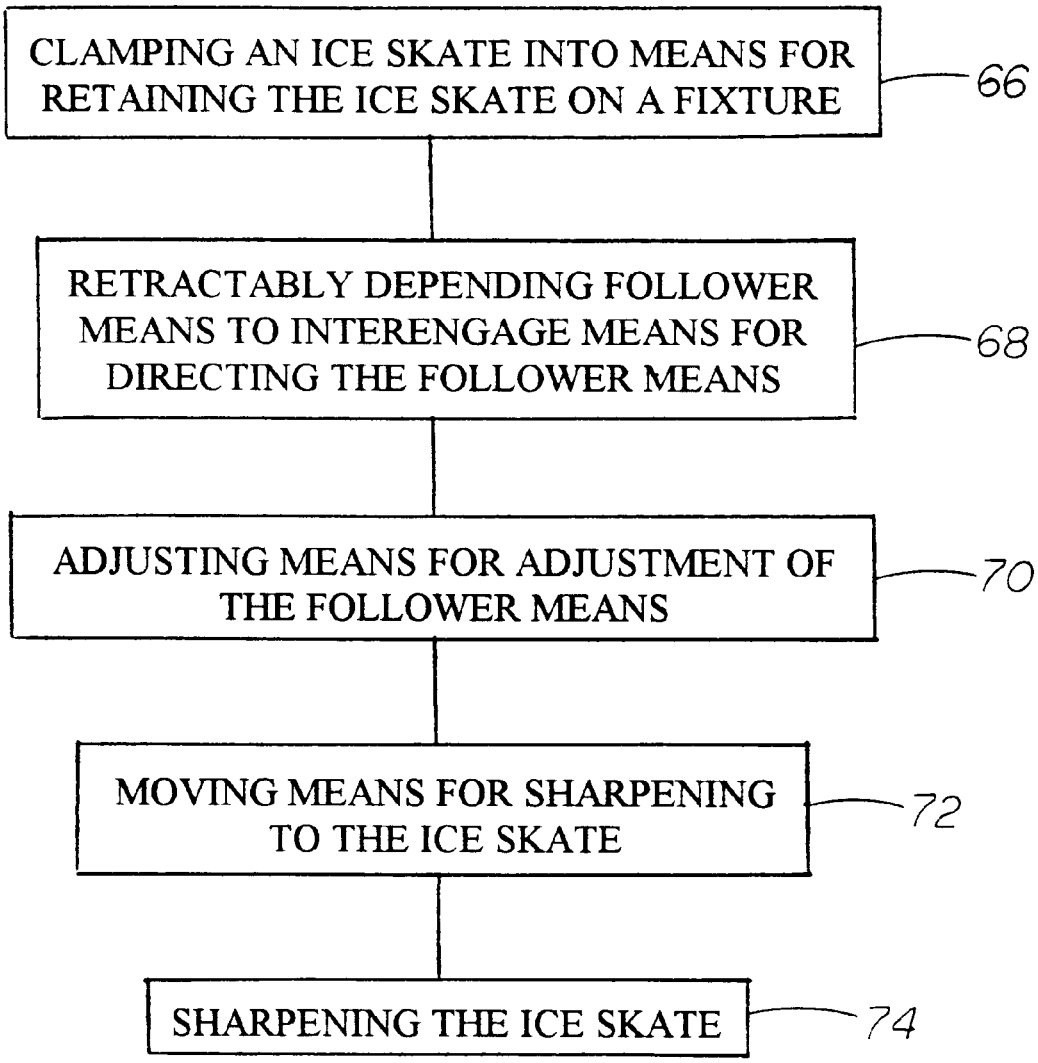
FIG. 8 illustrates the steps involved in the method for sharpening an ice skate blade.

Now turning to FIG. 8, the steps of the method of the invention are thereshown and described as follows.

The first step 66 is clamping an ice skate into the means for retaining an ice skate on a fixture.

The next step 68 is retractably depending follower means to interengage with means for directing the follower means.

The next step 70 is adjusting means for adjustment of the follower means.

The next step 72 is moving means for sharpening to the ice skate.

The next step 74 is contouring or sharpening the ice skate blade.

Thereafter, the next step (not shown) is retracting the follower means.

The subsequent step (not shown) if needed, is moving the fixture to a sharpening position.

The next step (not shown) if needed, is sharpening the blade.

Having described my invention, many modifications thereto will become apparent to those skilled in the art to which it pertains without deviation from the spirit of the invention as defined in the appended claims.

I claim:

1. An ice skate sharpening fixture having means for retaining an ice skate therein, the fixture having follower means thereon, the ice skate sharpening fixture comprising a base plate, the base plate having a planar underside, the follower means being movable above and below the planar underside of the base plate, and means for radially adjusting the follower means for pitching the blade of an ice skate held in the fixture, wherein the means for radially adjusting the follower means comprises an eccentric device on the follower means, wherein the follower means comprises a roller.

2. An ice skate sharpening device for placement on a flat surface having a top edge and means for directing recessed below the top edge of the flat surface, the device comprising a fixture according to claim 1 having means for retaining an ice skate therein, the fixture having follower means thereon, the ice skate sharpening device being placeable on the flat surface, means for directing the follower means, the means for directing the follower means being interengagable with the follower means and the means for directing the follower means being recessed below the top edge of the flat surface.

3. An ice skate sharpening device according to claim 2 further comprising a means for sharpening, the means for sharpening being movable into and away from the fixture.

4. An ice skate sharpening device according to claim 2 further comprising means for covering the means for directing the follower means, the means for covering fully covering the means for directing, thereby making a contiguous flat surface.

* * * * *